US007661668B2

(12) United States Patent
Inoue

(10) Patent No.: US 7,661,668 B2
(45) Date of Patent: Feb. 16, 2010

(54) SHEET-SPEED REDUCTION MECHANISM FOR FAN WHEEL

(75) Inventor: Hiroshi Inoue, Noda (JP)

(73) Assignee: Komori Corporation, Tokyo (JP)

( * ) Notice: Subject to any disclaimer, the term of this patent is extended or adjusted under 35 U.S.C. 154(b) by 0 days.

(21) Appl. No.: 12/078,659

(22) Filed: Apr. 2, 2008

(65) Prior Publication Data

US 2008/0252001 A1 Oct. 16, 2008

(30) Foreign Application Priority Data

Apr. 13, 2007 (JP) ..... 2007-105471

(51) Int. Cl.
*B65H 29/68* (2006.01)
*B65H 29/20* (2006.01)

(52) U.S. Cl. ..... 271/182; 271/315

(58) Field of Classification Search ..... 271/187, 271/315, 182
See application file for complete search history.

(56) References Cited

U.S. PATENT DOCUMENTS 3,851,773 A * 12/1974 Kluge et al. ..... 414/788.3
4,465,193 A * 8/1984 Kokubo et al. ..... 209/534
5,647,586 A * 7/1997 Novick et al. ..... 271/182

FOREIGN PATENT DOCUMENTS

JP 11-11769 A 1/1999

* cited by examiner

*Primary Examiner*—David H Bollinger
(74) *Attorney, Agent, or Firm*—Birch, Stewart, Kolasch & Birch, LLP

(57) ABSTRACT

A sheet-speed reduction mechanism for a fan wheel including: fan wheels that hold, between fan blades thereof, a signature transported from a printing press thereto, and that rotates with the held signature; a stopper portion that restricts the front end of the signature held between the fan blades, and that then discharges the signature from the inside of the fan wheels; and speed-reduction guides that presses a surface of the signature advancing between the fan blades before the front end of the signature comes into contact with the stopper portion, so as to reduce the advancing speed of the signature.

12 Claims, 8 Drawing Sheets

SHEET-SPEED REDUCTION MECHANISM FOR FAN WHEEL

BACKGROUND OF THE INVENTION

1. Field of the Invention

The present invention relates to a sheet-speed reduction mechanism for a fan wheel by which mechanism the speed of a signature transported from a folder of a printing press is reduced before the signature is held in the fan wheel.

2. Description of the Related Art

A web-fed rotary printing press is provided with a folder for forming a signature (sheet) from a web. The web is dried and cooled after a print is made thereon, and thereafter the folder cuts the web into pieces each having a predetermined length. The folder then folds each piece of the web along the width direction, or along the longitudinal direction, of the piece, so that the signature is formed. The signature thus folded by the folder is delivered to the outside of the printing press by a delivery device which is provided at the most downstream side, in a direction in which the signatures (web) are transported (hereinafter, referred to simply as the signature transporting direction), in the folder.

The signatures are transported at predetermined intervals to the delivery device. The delivery device grabs the signatures between fan blades of a rotating fan wheel one by one, thus holding the signatures therebetween. The delivery device then discharges the signatures onto a delivery conveyor disposed below the fan wheel. In this way, the signatures are placed at predetermined intervals on the delivery conveyor to be eventually delivered to the outside of the printing press.

In the above-described fan wheel, the movement of each signature advancing between the fan blades is firstly restricted, at the front end thereof, by a stopper, so that the signature is held by the stopper. Then, the signature is gradually discharged from between the fan blades in association with the rotation of the fan wheel. Thereafter, the signature is finally transferred almost horizontally onto the delivery conveyor. Such a fan wheel of the conventional delivery device is disclosed, for example, in Patent Document 1.

<Patent Document 1>

Japanese Patent Application Publication No. Hei. 11-11769

However, in such conventional fan wheel, a signature slid between the fan blades is caused to hit the stopper at the same speed as the sliding speed of the signature into the fan wheel. For this reason, the front end of the signature may be damaged or deformed. In addition, the signature may be caused to bounce off when hitting the stopper, thus protruding from the fan wheel. In this case, the signature may be brought into contact with a peripheral component of the fan wheel, thus being bent or stuck therein. As a result, the attitude of the signature in the fan wheel becomes unstable. If the signature is discharged onto the delivery conveyor in this unstable state, the following problem may occur. Specifically, a signature may be caused to overlap the preceding one, so that the intervals for the transport may become non-uniform. In addition, if a signature is bent or displaced, the accuracy in the delivery may be adversely affected.

SUMMARY OF THE INVENTION

In this respect, the present invention has been made for the purpose of solving the above-described problems. An object of the present invention is to provide a sheet-speed reduction mechanism for a fan wheel, which mechanism reduces the speed of an advancing sheet so as to prevent the sheet from being damaged or deformed, and also to suppress the bouncing off of the sheet so that the sheet can be discharged with a stable attitude.

A first aspect of the present invention for solving the above-described problems provides a sheet-speed reduction mechanism for a fan wheel. The sheet-speed reduction mechanism includes a fan wheel, a stopper, and speed-reduction means. The fan wheel holds, between fan blades thereof, a sheet transported from a printing press thereto, and rotates with the held sheet. The stopper restricts the front end of the sheet held between the fan blades, and then discharges the sheet from the inside of the fan wheel. The speed-reduction means presses a surface of the sheet advancing between the fan blades before the front end of the sheet comes into contact with the stopper, so as to reduce the speed of the sheet.

A second aspect of the present invention for solving the above-described problems provides the sheet-speed reduction mechanism for a fan wheel according to the first aspect with the following characteristics. Specifically, the speed-reduction means is provided to the stopper.

A third aspect of the present invention for solving the above-described problems provides the sheet-speed reduction mechanism for a fan wheel according to the first aspect with the following characteristics. Specifically, the speed-reduction means includes a pressing surface which is formed to have substantially the same radius of curvature as that of a surface, on the upstream side of the rotational direction of the fan wheels, of each of the fan blades.

A fourth aspect of the present invention for solving the above-described problems provides the sheet-speed reduction mechanism for a fan wheel according to the first aspect with the following characteristics. Specifically, the speed-reduction means moves on the basis of any one of the quality, the thickness, and the folding specification, of the sheet.

A fifth aspect of the present invention for solving the above-described problems provides the sheet-speed reduction mechanism for a fan wheel according to the fourth aspect with the following characteristics. Specifically, the speed-reduction means moves in the up and down directions.

A sixth aspect of the present invention for solving the above-described problems provides the sheet-speed reduction mechanism for a fan wheel according to the fourth aspect with the following characteristics. Specifically, the speed-reduction means is configured: to move so as to increase the pressing force thereof against the surface of the sheet when the speed of the printing press is equal to or higher than a predetermined speed; and to move so as to decrease the pressing force thereof against the surface of the sheet when the speed of the printing press is lower than the predetermined speed.

A seventh aspect of the present invention for solving the above-described problems provides the sheet-speed reduction mechanism for a fan wheel according to the fourth aspect with the following characteristics. Specifically, the speed-reduction means is configured: to move so as to increase the pressing force thereof against the surface of the sheet when the speed of the printing press is higher than a predetermined speed; and to move so as to decrease the pressing force thereof against the surface of the sheet when the speed of the printing press is equal to or lower than the predetermined speed.

An eighth aspect of the present invention for solving the above-described problems provides the sheet-speed reduction mechanism for a fan wheel according to the fourth aspect with the following characteristics. Specifically, the speed-reduction means is configured: to move to a high-speed pressing position so as to apply a first pressing force to the surface of the sheet when the speed of the printing press is equal to or higher than a predetermined speed; and to move to a low-speed pressing position so as to apply a second pressing force to the surface of the sheet when the speed of the printing press is lower than a predetermined speed, the second pressing force being smaller than the first pressing force.

A ninth aspect of the present invention for solving the above-described problems provides the sheet-speed reduction mechanism for a fan wheel according to the fourth aspect with the following characteristics. Specifically, the speed-reduction means is configured: to move to a high-speed pressing position so as to apply a first pressing force to the surface of the sheet when the speed of the printing press is higher than a predetermined speed; and to move to a low-speed pressing position so as to apply a second pressing force to the surface of the sheet when the speed of the printing press is equal to or lower than the predetermined speed, the second pressing force being smaller than the first pressing force.

A tenth aspect of the present invention for solving the above-described problems provides the sheet-speed reduction mechanism for a fan wheel according to any one of the eighth and ninth aspects with the following characteristics. Specifically, the low-speed pressing position is located above the high-speed pressing position.

An eleventh aspect of the present invention for solving the above-described problems provides the sheet-speed reduction mechanism for a fan wheel according to the fourth aspect with the following characteristics. Specifically, the sheet-speed reduction mechanism further includes: a movable member which supports the speed-reduction means; and moving means which moves the movable member.

A twelfth aspect of the present invention for solving the above-described problems provides the sheet-speed reduction mechanism for a fan wheel according to the eleventh aspect with the following characteristics. Specifically, the sheet-speed reduction mechanism further includes: a supporting member which movably supports the movable member with a guide member disposed in between; and a spring which is set between the guide member and the supporting member.

A thirteenth aspect of the present invention for solving the above-described problems provides the sheet-speed reduction mechanism for a fan wheel according to the twelfth aspect with the following characteristics. Specifically, the moving means includes a screw shaft which is screwed into the movable member, and also which is rotatably supported by the supporting member; and a motor which rotates the screw shaft.

A fourteenth aspect of the present invention for solving the above-described problems provides the sheet-speed reduction mechanism for a fan wheel according to the first aspect with the following characteristics. Specifically, the multiple fan wheels are arranged in a direction of the rotational axis of the fan wheels. In addition, the speed-reduction means is provided between adjacent two of the fan wheels.

A fifteenth aspect of the present invention for solving the above-described problems provides the sheet-speed reduction mechanism for a fan wheel according to the fourteenth aspect with the following characteristics. Specifically, a surface of the sheet is guided by a surface, on the upstream side of the rotational direction of the fan wheels, of each fan blade of each fan wheel. In addition, the other surface of the sheet is guided by the speed-reduction means.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF THE INVENTION

Hereinafter, a sheet-speed reduction mechanism for a fan wheel according to the present invention will be described in detail with reference to the accompanying drawings.

Figure 1:
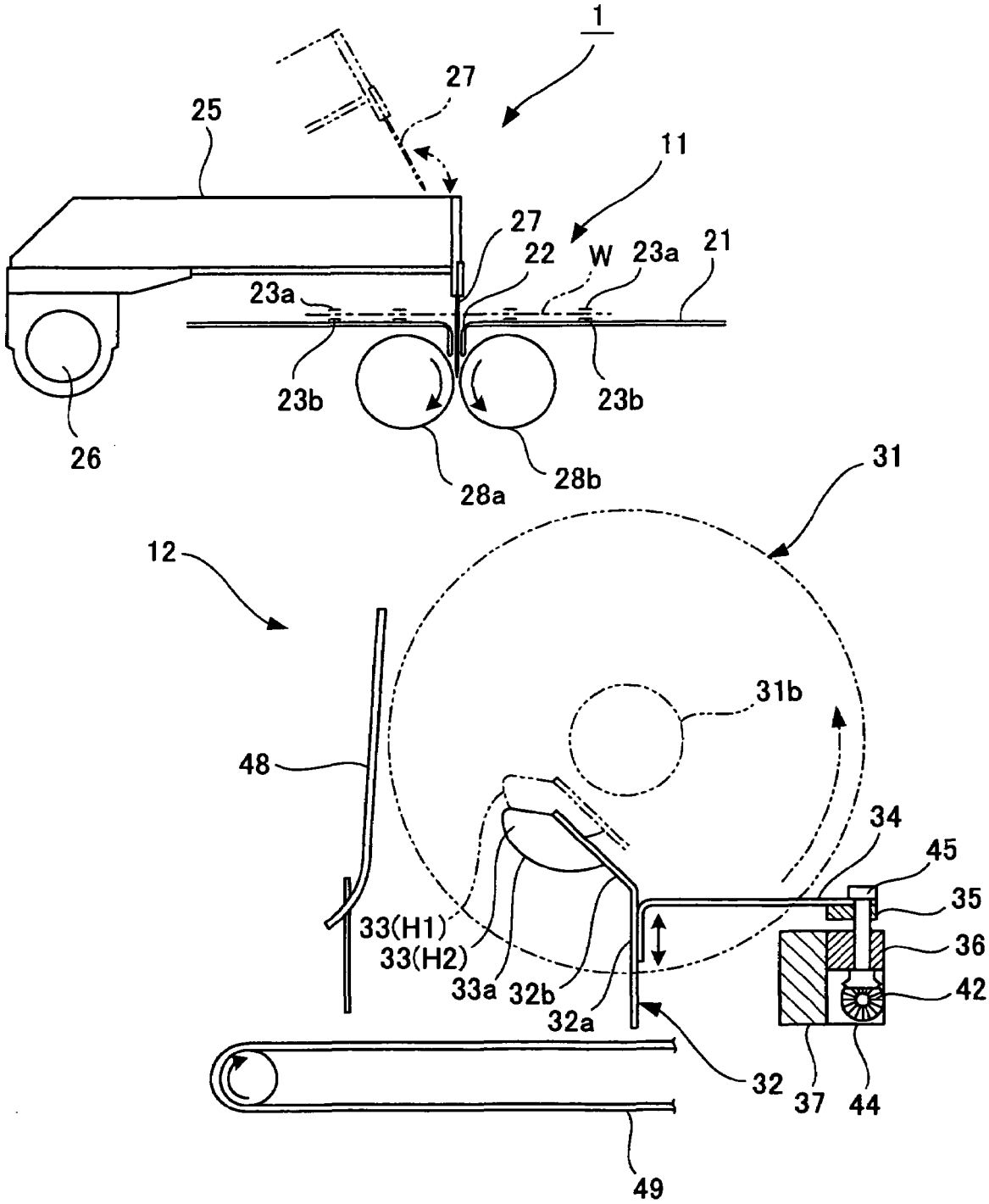
FIG. 1 shows a front view of a sheet-speed reduction mechanism for a fan wheel, according to an embodiment of the present invention.

As shown in FIG. 1, a folder 1 is installed in an unillustrated web-fed rotary printing press. The folder 1 is provided with a chopper folding device 11 for chopper-folding a signature W. In addition, a delivery device 12 for delivering the signature W to the outside of the printing press is provided to the downstream (the lower side), in the signature transporting direction, of the chopper folding device 11.

As shown in FIG. 1, a plate-shaped table 21 is substantially horizontally disposed in the chopper folding device 11. Above the top surface of the table 21, multiple transporting belts, that is, a pair of upper and lower belts 23*a* and 23*b* are provided in a stretched manner. The signature W is held by these transporting belts 23*a* and 23*b* from above and below so as to be transported. In addition, a slit 22 is formed, along the signature transporting direction, in a substantially center portion, in the width direction, of the table 21.

A chopper arm 25 is disposed above the table 21. An arm shaft 26 is provided in the proximal end portion of the chopper arm 25. The arm shaft 26 is rotatably supported, at the two ends thereof, by folder frames 24*a* and 24*b* (see FIGS. 2 and 3). In addition, an unillustrated arm-shaft driving motor is connected to one end of the arm shaft 26. On the other hand, a chopper blade 27 for chopper-folding the signature W transported by the transporting belts 23*a* and 23*b* is provided to the distal end of the chopper arm 25. With this structure, the driving of the arm-shaft driving motor causes the chopper arm 25 to rotate the chopper blade 27 in the up and down directions about the arm shaft 26.

Moreover, a pair of left and right nipping rollers 28*a* and 28*b* are disposed below the table 21. Each of the nipping rollers 28*a* and 28*b* is rotatably supported, at the two ends thereof, by the folder frames 24*a* and 24*b*. The point (contact point) at which the nipping rollers 28*a* and 28*b* face is arranged vertically below the center portion, in the width direction, of an opening portion of the slit 22. Moreover, an unillustrated moving mechanism and an unillustrated roller-driving motor are connected to the nipping rollers 28*a* and 28*b*. The nipping rollers 28*a* and 28*b* are moved by the moving mechanism so as to be brought close to each other, or to be separated from each other, in the width direction of a signature. The nipping rollers 28*a* and 28*b* are rotated in the opposite directions to each other by the roller-driving motor. With this structure, the driving of the moving mechanism allows the gap between the nipping rollers 28*a* and 28*b* to be adjusted in accordance with the thickness of the chopper-folded signature W. At the same time, the driving of the roller-driving motor rotates the nipping rollers 28*a* and 28*b* in the opposite directions to each other, so that the chopper-folded signature W advancing the gap between the nipping rollers 28*a* and 28*b* is transported downward.

Figure 2:
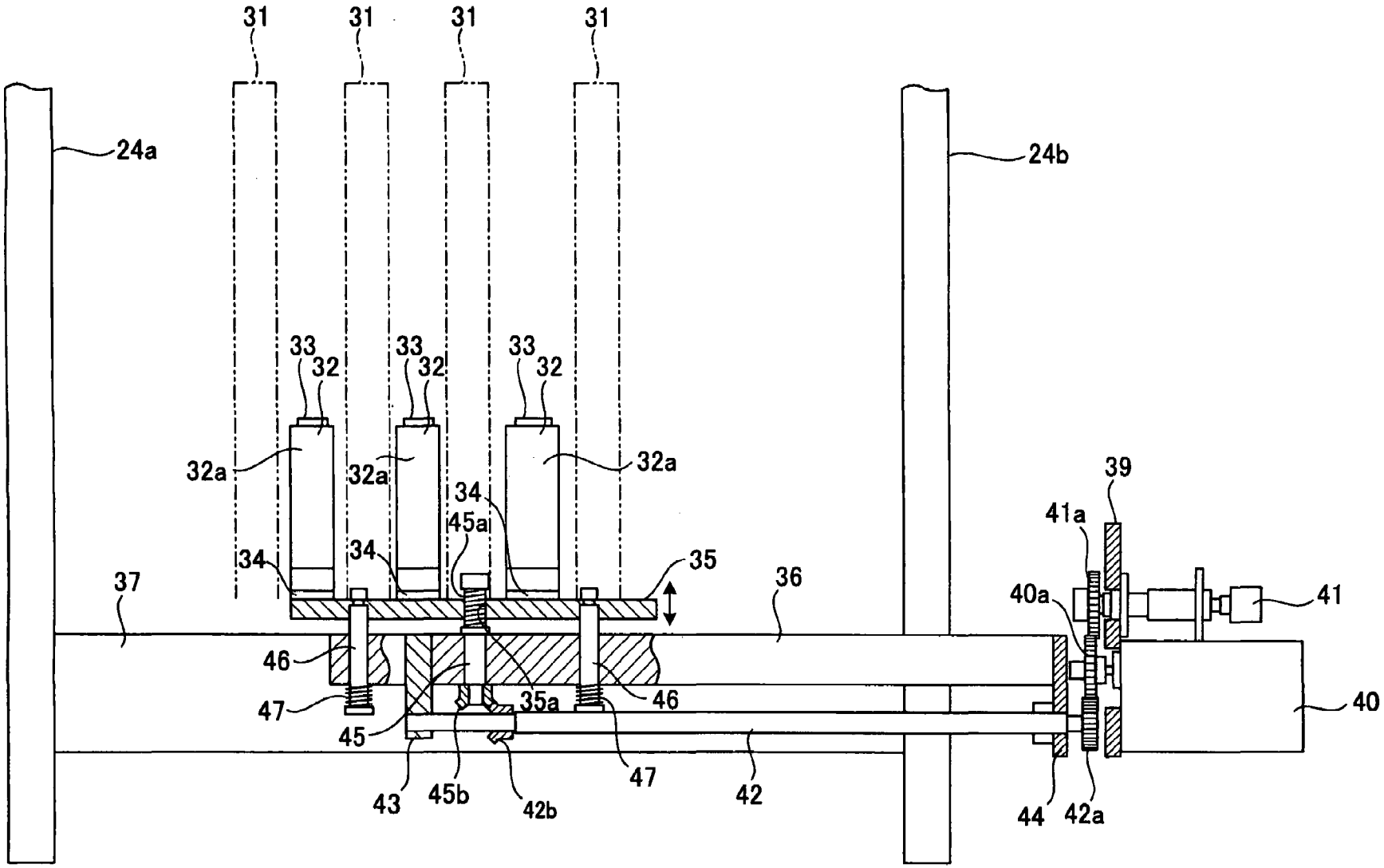
FIG. 2 shows a side view of the sheet-speed reduction mechanism of FIG. 1.
Figure 3:
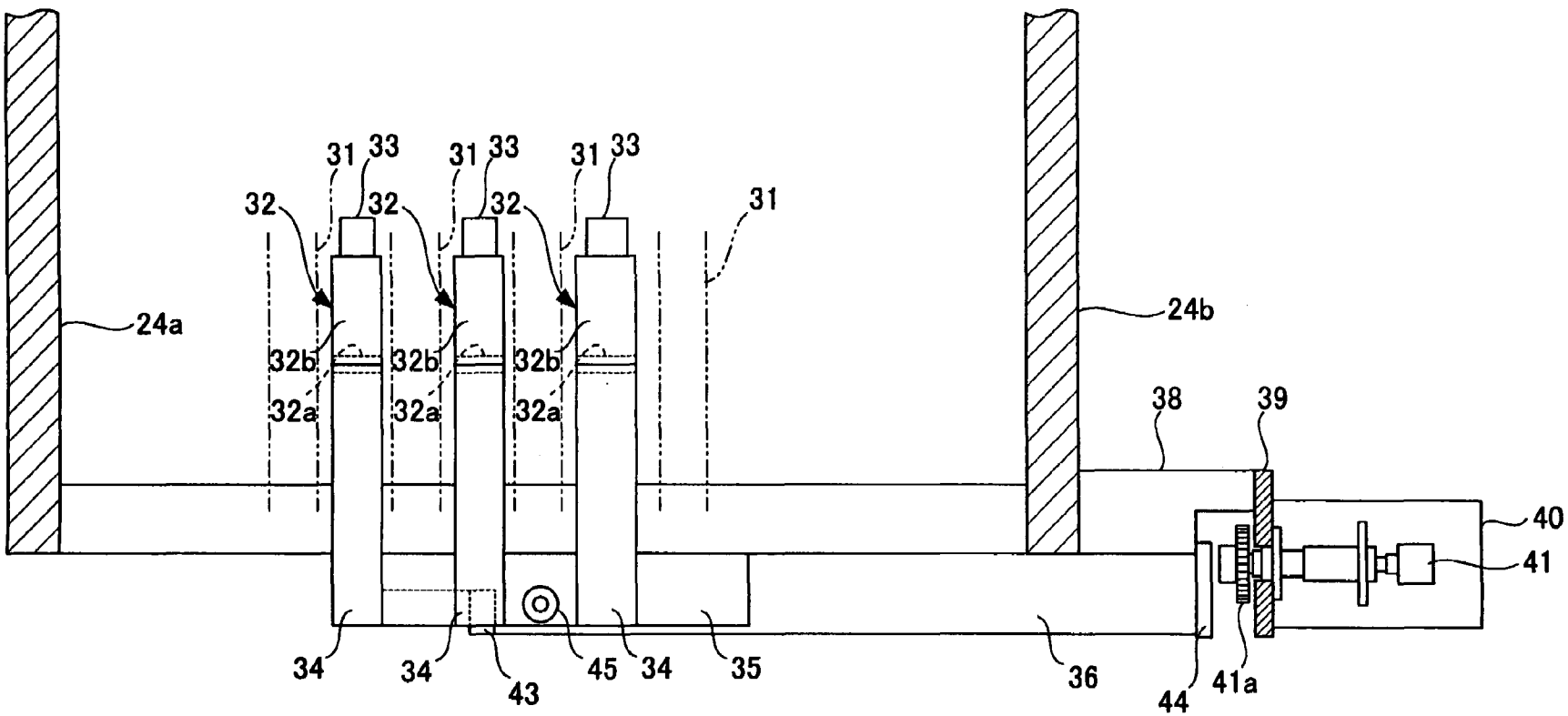
FIG. 3 shows a plan view of the sheet-speed reduction mechanism of FIG. 1.

On the other hand, as shown in FIGS. 1 to 3, in the delivery device 12, four fan wheels 31 are disposed below the nipping rollers 28*a* and 28*b*. These fan wheels 31 are arranged to be separated from one another at predetermined intervals, on a rotational shaft 31*b* for the fan wheels 31. The rotational shaft 31*b* is rotatably supported, at the two ends thereof, by the folder frames 24*a* and 24*b*. The rotational shaft 31*b* is connected to an unillustrated rotational-shaft-driving motor. In addition, each of the fan wheels 31 includes multiple fan blades 31*a*. Each of these fan blades 31*a* is curved toward the rotational shaft 31*b* as extending from the upstream side to the downstream side in the rotational direction of the fan wheels 31. Accordingly, a surface 31*c* of each of the fan blades 31*a* is formed to have a predetermined radius of curvature (see FIG. 5). With this structure, the driving of the rotational-shaft-driving motor causes the fan wheels 31 to rotate. The fan wheels 31 thus take in the signatures W transported from the chopper folding device 11 one by one between the fan blades 31*a*, so that the signatures W is held therein.

A plate-shaped stripper 32 is disposed between each adjacent two of the fan wheels 31. Each of the strippers 32 is formed of a stopper portion 32*a* and a supporting portion 32*b*. Each of the stopper portions 32*a* is arranged in the vertical direction, while each of the supporting portions 32*b* extends upward obliquely from the end portion of the corresponding one of the stopper portions 32*a*. In addition, a speed-reduction guide (speed-reduction means) 33 is provided to the end portion of each of the supporting portions 32*b*. A curved pressing surface 33*a* protruding downward is formed in the lower portion of each of the speed-reduction guides 33. Each of the pressing surfaces 33*a* is formed to have substantially the same radius of curvature as that of the surface 31*c*, on the upstream side in the rotational direction, of each of the fan blades 31*a* of each of the fan wheels 31.

Each of the strippers 32 is supported on a movable member 35 with a supporting plate 34 provided in between. A supporting member 36 is disposed below the movable member 35. The supporting member 36 is attached to the outer surface of a beam member 37 supported between the folder frames 24*a* and 24*b*.

An end of the supporting member 36 is disposed on the outer side of the folder frame 24*b*. An attachment plate 39 is joined to the side surface of the end of the supporting member 36 by a joint member 38 disposed in between. A speed-reduction-guide moving motor 40 and a speed-reduction-guide rotary encoder 41 are attached to the attachment plate 39. The output shaft of the speed-reduction-guide moving motor 40 and the input shaft of the speed-reduction-guide rotary encoder 41 penetrate the attachment plate 39. A spur gear 40*a* is provided to the output shaft, while a spur gear 41*a* is provided to the input shaft. The spur gear 40*a* and the spur gear 41*a* engage with each other on the inner side of the attachment plate 39.

In addition, a horizontal rod 42 is arranged in the horizontal direction below the supporting member 36. The horizontal rod 42 is rotatably supported by rod-supporting members 43 and 44 both of which are attached to the supporting member 36. An end of the horizontal rod 42 penetrates the rod-supporting member 44. A spur gear 42*a* is provided to this end of the horizontal rod 42, while a bevel gear 42*b* is provided to the other end thereof below the supporting member 36. The spur gear 42*a* engages with the spur gear 40*a* of the speed-reduction-guide moving motor 40.

A vertical rod (a screw shaft) 45 and guide members 46 are disposed in the vertical direction to penetrate the movable member 35 and the supporting member 36. A male screw portion 45*a* is formed in the upper end of the vertical rod 45, while a bevel gear 45*b* is provided to the lower end thereof. The male screw portion 45*a* is screwed into a female screw portion 35*a* which is a through hole formed in substantially the center portion, in the longitudinal direction, of the movable member 35. Meanwhile, the bevel gear 45*b* engages with the bevel gear 42*b* of the horizontal rod 42, below the supporting member 36.

Moreover, the upper end of each of the guide members 46 is fixed to the movable member 35, while the lower end thereof is provided with a spring 47 which is set between the guide member 46 and the supporting member 36. The spring 47 is set, in a compressed state, between the supporting member 36 and the lower end of the guide member 46, so that the guide member 46 is biased downward by the biasing force of the spring 47. In other words, the spring 47 is configured to absorb a backlash between the male screw portion 45*a* of the vertical rod 45 and the female screw portion 35*a* of the movable member 35.

With this structure, the driving of the speed-reduction-guide moving motor 40 in the normal and reverse directions causes the vertical rod 45 to rotate in association with the horizontal rod 42. In accordance with the rotation of the vertical rod 45, the movable member 35 engaging with the vertical rod 45 moves in the up and down directions. Then, the movement of the movable member 35 in the up and down directions further causes the stripper 32 to move in the up and down directions. In addition, the movable member 35 moves while being guided, at the two end portions thereof, by the guide members 46, which is biased by the springs 47. Accordingly, the movable member 35 is always held horizontally, so that the height positions of the respective speed-reduction guides 33 are always kept at the same level. It should be noted that, at all the time of driving the speed-reduction-guide moving motor 40, the rotational angle of the speed-reduction-guide moving motor 40 is detected by the speed-reduction-guide rotary encoder 41.

Three guides 48 (only one of them is illustrated in FIG. 1) are provided to the side of the fan wheels 31. The guides 48 are arranged at predetermined intervals in the width direction of a signature so as to face the corresponding strippers 32. The provision of the guides 48 to the side of the fan wheels 31 in this manner makes it possible to guide the rear end of the signature W held in the fan wheels 31.

Moreover, a delivery conveyor 49 is provided below the fan wheels 31. The delivery conveyor 49 delivers, to the outside of the printing press, the signature W that is discharged from the fan wheels 31. The delivery conveyor 49 is connected to an unillustrated conveyor driving motor. With this structure, the driving of the conveyor driving motor causes the delivery conveyor 49 to rotate so that the signature W is delivered to the outside of the printing press.

Figure 4:
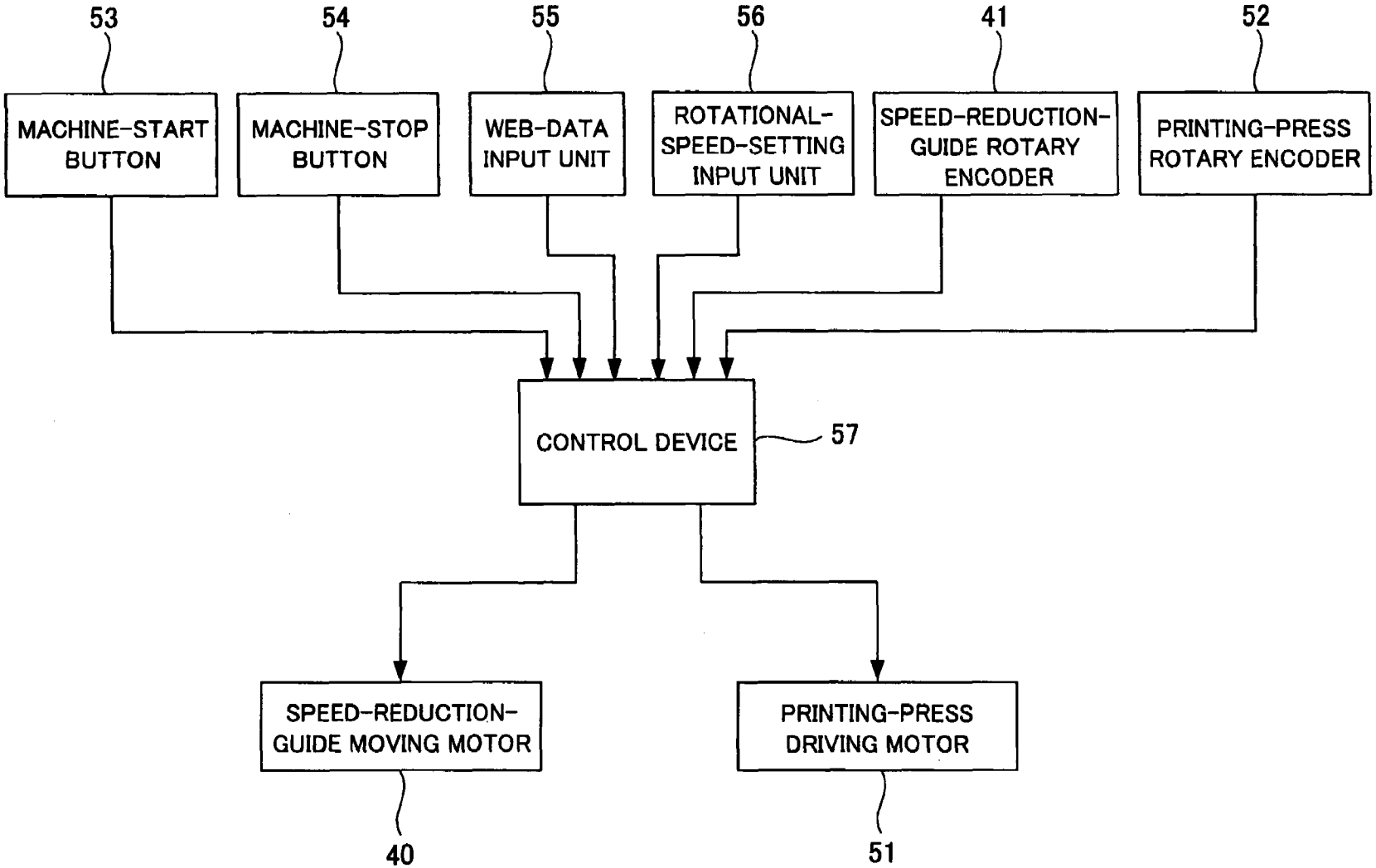
FIG. 4 shows a block diagram showing the connection state with a control device.

Here, as shown in FIG. 4, the unillustrated web-fed rotary printing press is provided also with a printing-press driving motor 51 for driving the printing press as a whole. A printing-press rotary encoder 52 for detecting the rotational speed of the printing-press driving motor 51 is attached to the printing-press driving motor 51. Moreover, the web-fed rotary printing press is configured to operate in accordance with the operation of the operator. The web-fed rotary printing press has an unillustrated control panel provided with a machine-start button 53, a machine-stop button 54, a web-data input unit 55, a rotational-speed-setting input unit 56, and the like.

Accordingly, the operator is allowed to start or stop the printing-press driving motor 51 by operating the machine-start button 53 or the machine-stop button 54, so as to manipulate the operation of the web-fed rotary printing press. In addition, web data is inputted to the web-data input unit 55. Here, the web data includes a paper quality, a paper thickness, a folding specification (single-parallel folding, double-parallel folding, or delta folding), and the like. On the other hand, a set rotational speed No, which will be described later, is inputted to the rotational-speed-setting input unit 56. The set rotational speed No is a rotational speed of the printing-press driving motor 51 at the time of changing the height position of the speed-reduction guides 33.

In addition, the web-fed rotary printing press is provided with a control device 57 which performs the driving control on the entire printing press. Specifically, the machine-start button 53, the machine-stop button 54, the web-data input unit 55, the rotational-speed-setting input unit 56, the speed-reduction-guide rotary encoder 41, the printing-press rotary encoder 52, the speed-reduction-guide moving motor 40, and the printing-press driving motor 51, are connected to the control device 57. Signals are sent to the control device 57 from the machine-start button 53, the machine-stop button 54, the web-data input unit 55, the rotational-speed-setting input unit 56, the speed-reduction-guide rotary encoder 41, and the printing-press rotary encoder 52. On the basis of these signals, the control device 57 outputs signals to, and thus drives, the speed-reduction-guide moving motor 40 and the printing-press driving motor 51, so that the height position of the speed-reduction guides 33 is changed. In this way, the speed-reduction control is performed on the signature W advancing between the fan blades 31*a* of the fan wheels 31.

Accordingly, with the above-described configuration, a web fed to the inside of the web-fed rotary printing press is dried and cooled after a print is made thereon. Thereafter, in the upstream side, in the signature (web) transporting direction, of the folder 1, the web is formed into a parallel single folded signature W, a parallel double folded signature W, a delta folded signature W, or the like, by an unillustrated folding device. Here, the folding device consists of a cut-off cylinder, a folding cylinder, a jaw cylinder, a transfer cylinder, and the like. Subsequently, the signature W is transferred to the chopper-folding device 11 on the downstream side, in the signature transporting direction, of the folding device.

The signature W transferred to the chopper-folding device 11 is further transported on the table 21 while being held by the transporting belts 23*a* and 23*b*. The signature W is thus transported to the downstream end, in the signature transporting direction, of the table 21. While the signature W is transported to the downstream end, the chopper arm 25 disposed at the uppermost position is rotated downward, so that the chopper blade 27 performs chopper-folding on the signature W at substantially the center portion, in the width direction, of the signature W.

At this time, the downward rotation of the chopper arm 25 causes the chopper blade 27 to pass through the opening portion of the slit 22, then to advance into the gap between the nipping rollers 28*a* and 28*b*, and as a result, to be disposed at the lowest position (the deepest position). Accordingly, when the signature W is transported to the downstream end, in the signature transporting direction, of the table 21, the signature W is tucked into the opening portion of the slit 22 while being chopper-folded by the chopper blade 27 in association with the downward rotation of the chopper arm 25. The signature W thereby reaches the gap between the nipping rollers 28*a* and 28*b*. As a result, a fold line is formed in the signature W by causing the signature W to pass through the gap between the nipping rollers 28*a* and 28*b*.

Figure 5:
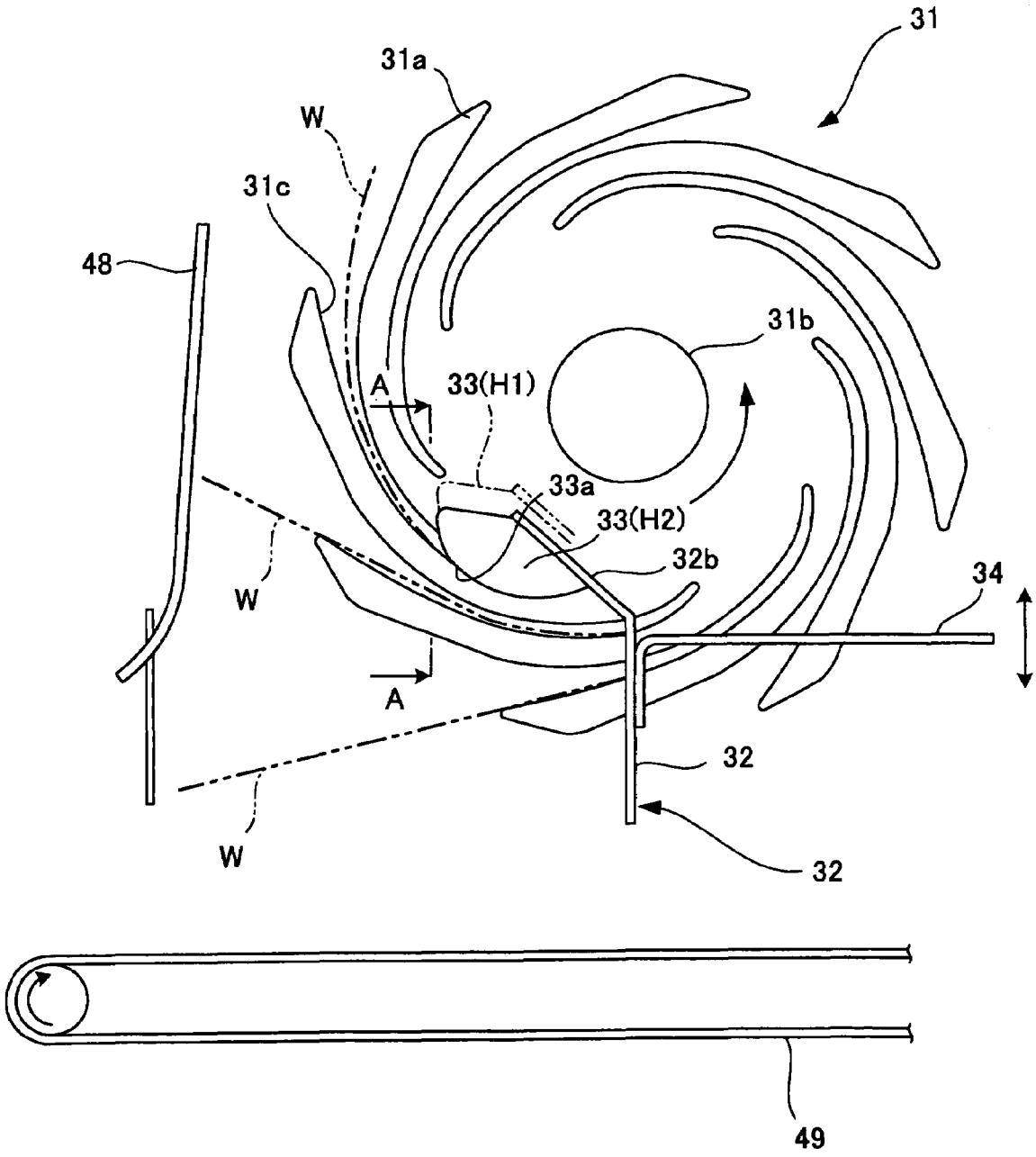
FIG. 5 shows how a speed-reduction guide reduces the speed of a signature advancing in the fan wheels.

Subsequently, as shown in FIG. 5, the signature W having passed through the gap between the nipping rollers 28*a* and 28*b* is transported between the fan blades 31*a* of the rotating fan wheels 31. The signature W thus transported between the fan blades 31*a* then advances, along the surfaces 31*c* of the fan blades 31*a*, toward the bottom of the fan blades 31*a*, in association with the rotation of the fan wheels 31. At this time, although detailed descriptions will be given later, the speed-reduction guides 33 have been moved, in terms of the height position thereof, from a low-speed pressing position H1 to a high-speed pressing position H2, by the driving of the speed-reduction-guide moving motor 40. Here, the high-speed pressing position H2 is located lower than the low-speed pressing position H1 (see FIGS. 1, 5, and 6).

Figure 6:
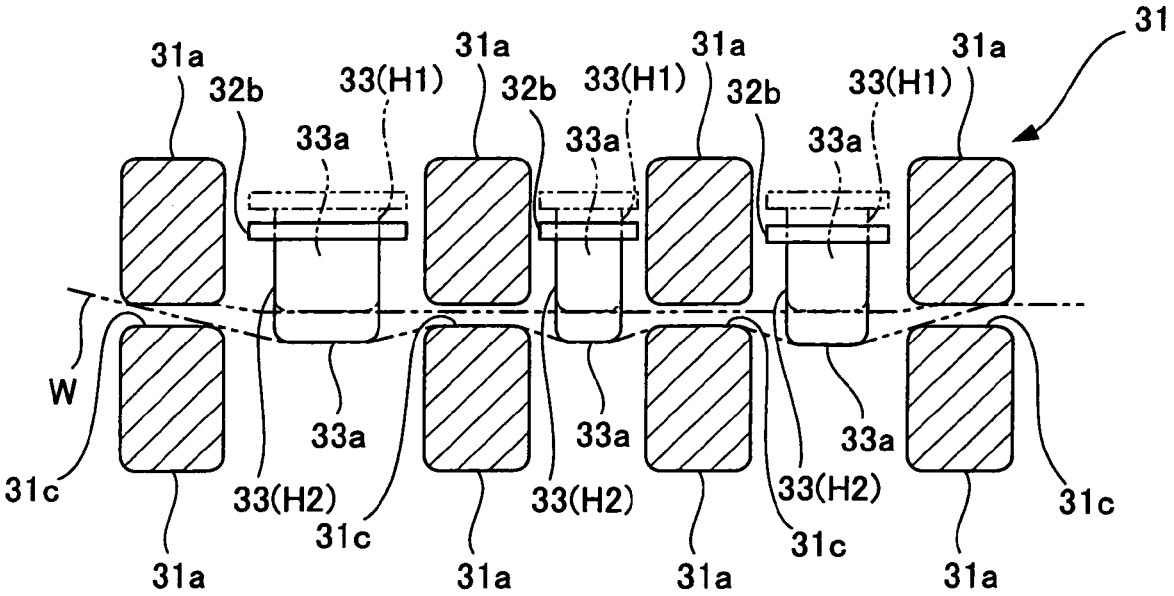
FIG. 6 shows a cross-sectional view taken along the line A-A, and as viewed in the direction of the arrows A in FIG. 5.

When the fan wheels 31 rotate to a predetermined rotational angle, the upper surface (a surface) of the signature W having advanced between the fan blades 31*a* starts to be brought into contact with the pressing surfaces 33*a* of the speed-reduction guides 33, so that the speed of the signature W starts to be reduced by the speed-reduction guides 33. Thereafter, as shown in FIG. 6, further rotation of the fan wheels 31 causes the signature W to advance along the pressing surfaces 33*a* of the speed-reduction guides 33, while the upper surface of the signature W is kept in surface contact with the pressing surfaces 33*a*. In this manner, the advancing speed of the signature W is gradually reduced.

Note that, the pressing surface 33*a* of each of the speed-reduction guides 33 has substantially the same radius of curvature as that of the surface 31*c* of each of the fan blades 31*a*. For this reason, during the above-described speed-reduction operation of the speed-reduction guides 33, the upper surface of the signature W held in the rotating fan wheels 31 is allowed to be pressed by the pressing surfaces 33*a* from the upstream side in the rotational direction of the fan wheels 31. Accordingly, it is possible to smoothly reduce the speed of the signature W without damaging or deforming the signature W held in the fan wheels 31.

Subsequently, when the fan wheels 31 further rotate, the signature W with a speed having reduced to a predetermined advancing speed is caused to come into contact, at the front end portion thereof, with the stopper portion 32*a* of the stripper 32, so as to be restricted (brought into a held state). After that, the signature W is transferred to the delivery conveyor 49 while being guided, at the rear end thereof, by the guides 48. At this time, the speed of the signature W has been sufficiently reduced by the speed-reduction guides 33. Accordingly, even when the signature W comes into contact with the stopper portion 32*a*, the front end of the signature W is not damaged or deformed, and further the signature W itself does not bounce off. Consequently, the signature W held on the delivery conveyor 49 is delivered by the delivery conveyor 49 to the outside of the printing press.

As described above, the signature W having advanced between the fan blades 31*a* of the fan wheels 31 is held while the speed of the signature W is gradually reduced by the speed-reduction guides 33. Here, the height position of the speed-reduction guides 33 at this time is set on the basis of the web data, such as the paper quality, the paper thickness, and the folding specification, which has been inputted in advance to the web-data input unit 55.

However, the rotational speed of the printing-press driving motor 51 is low, immediately after the start of the operation, and immediately before the stop of the operation, of the web-fed rotary printing press. For this reason, the advancing speed (the transporting speed) of the signature W is also low. If the signature W advancing into the fan wheels 31 at such a low advancing speed is further decelerated by the speed-reduction guides 33, the signature W can advance only by a distance corresponding to the low advancing speed, so that the signature W may not come into contact with the stopper portion 32*a* of the stripper 32. In this case, the signature W fails to be held in the fan wheels 31, and eventually, may possibly be caused to fall out therefrom by the rotation of the fan wheels 31.

In this respect, the control device 57 is configured to perform a speed-reduction control. In this speed-reduction control, the control device 57 changes the height position of the speed-reduction guides 33 on the basis of the rotational speed of the printing-press driving motor 51 (the advancing speed of the signature W into the space between the fan blades 31*a*), so that the pressing force of the pressing surfaces 33*a* of the speed-reduction guides 33 against the signature W is adjusted. Specifically, when the rotational speed of the printing-press driving motor 51 is in a low-rotational-speed range, the control device 57 increases the height position of the speed-reduction guides 33. In other words, the control device 57 sets the height position of the speed-reduction guides 33 at the low-speed pressing position H1, so that the pressing force of the speed-reduction guides 33 is reduced. On the other hand, when the rotational speed of the printing-press driving motor 51 is in a high-rotational-speed range, the control device 57 decreases the height position of the speed-reduction guides 33. In other words, the control device 57 sets the height position of the speed-reduction guides 33 at the high-speed pressing position H2, so that the pressing force of the speed-reduction guides 33 is increased.

Such speed-reduction control of the control device 57 will be described with reference to FIG. 7. Note that, in FIG. 7, the solid line indicates change in the rotational speed N of the printing-press driving motor 51, while the alternate long and two short dashes line indicates change in the height position of the speed-reduction guides 33.

Figure 7:
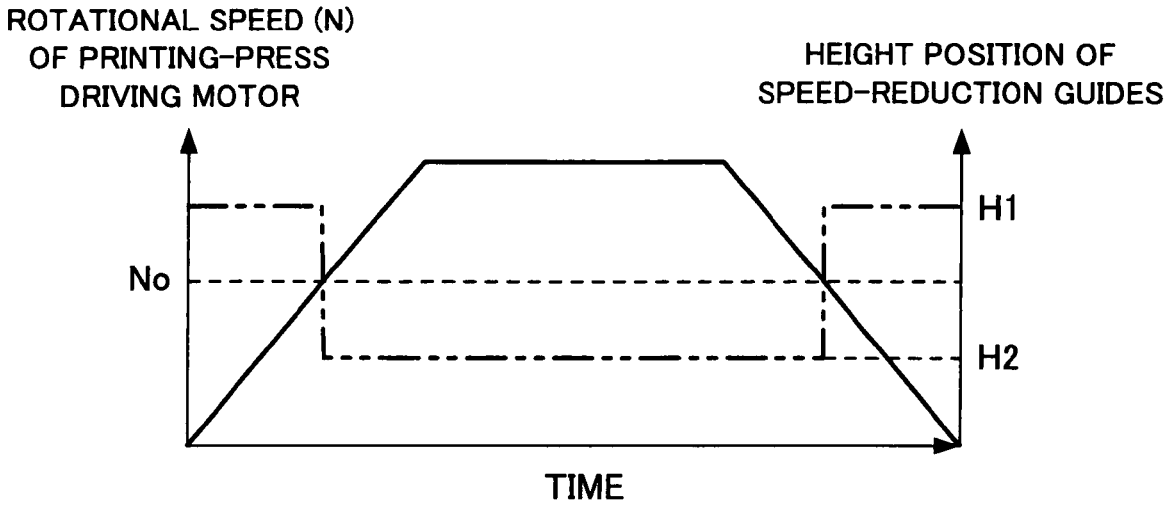
FIG. 7 shows a relation between the rotational speed of a printing-press driving motor and the height position of the speed-reduction guide in relation to time course.
Figure 8:
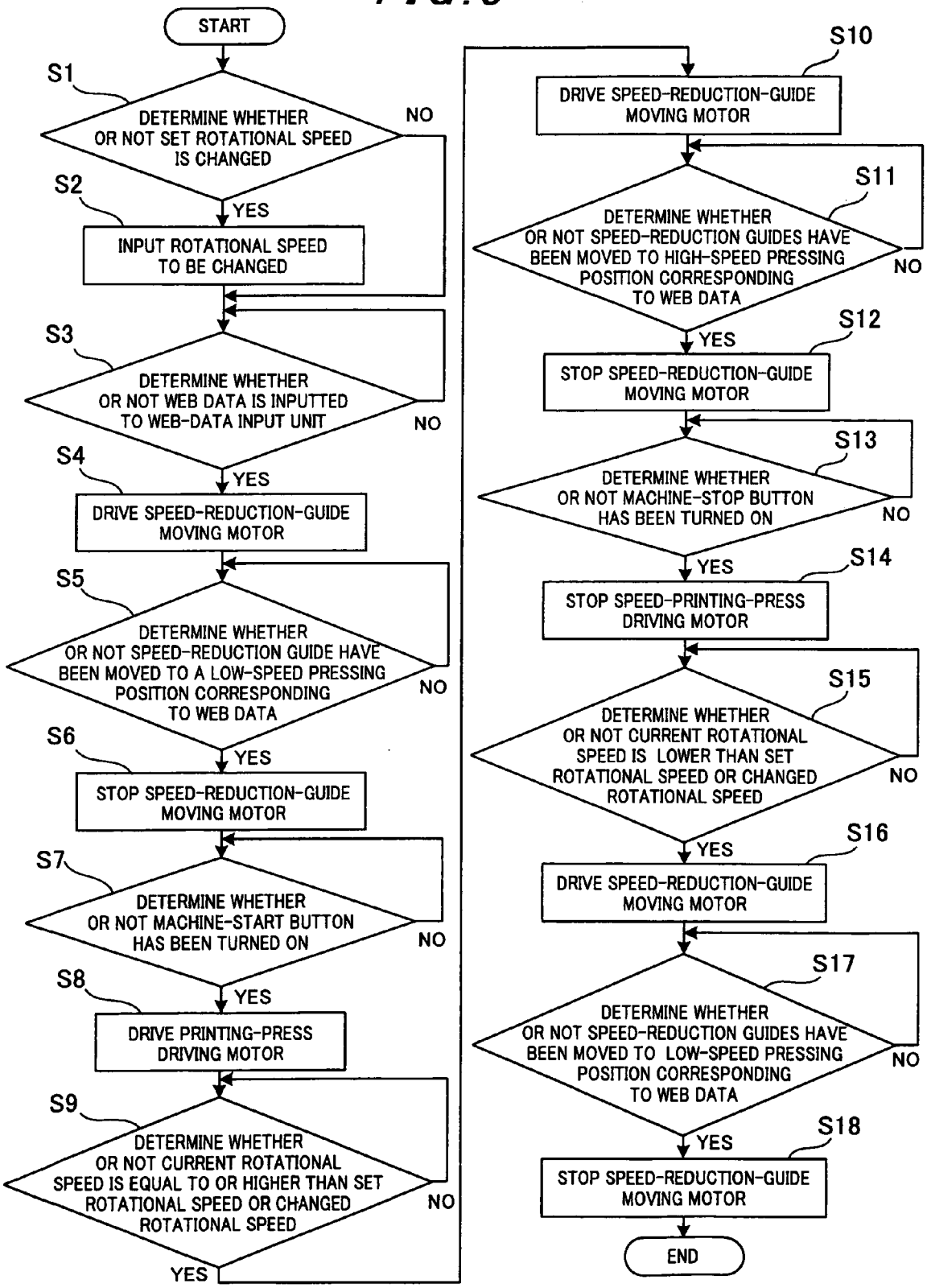
FIG. 8 shows a flowchart of the moving operation of the speed-reduction guide.

As shown in FIG. 7, at the same time as the driving of the printing-press driving motor 51, the printing of the web is started. After the printing, the web is dried and cooled, and is then cut into pieces each with a predetermined length. Each of the cut pieces is folded along the width direction or the longitudinal direction thereof to be the signature W. At this time, the rotational speed N of the printing-press driving motor 51 is low immediately after the start of the driving of the printing-press driving motor 51. For this reason, the speed-reduction guides 33 are moved to the low-speed pressing position H1 corresponding to the low-rotational-speed range of the printing-press driving motor 51. With this movement, the pressing surfaces 33*a* of the speed-reduction guides 33 are caused to apply a small pressing force to the upper surface of the signature W advancing at a low speed. As a result, even though the speed of the signature W is reduced by the pressing force of the pressing surfaces 33*a*, the signature W advancing at the low speed does not stop on the way, and is thus allowed to come into contact with, and held by, the stopper portion 32*a* of the stripper 32. Then, as the rotational speed N of the printing-press driving motor 51 is gradually increased, the advancing speed of the signature W is also increased.

Subsequently, when the rotational speed N of the printing-press driving motor 51 becomes equal to or higher than the set rotational speed No which is set in advance in the rotational-speed-setting input unit 56, the driving of the speed-reduction-guide moving motor 40 causes the speed-reduction guides 33 to move from the low-speed pressing position H1 to the high-speed pressing position H2 corresponding to the high-rotational-speed range. At this time, since the high-speed pressing position H2 is disposed below the low-speed pressing position H1, the pressing force of the pressing surfaces 33*a* of the speed-reduction guides 33 at the high-speed pressing position H2 becomes larger than the pressing force thereof at the low-speed pressing position H1. Accordingly, the pressing surfaces 33*a* of the speed-reduction guides 33 apply a large pressing force to the upper surface of the signature W advancing at a high speed. As a result, the speed of the signature W advancing at the high speed is sufficiently reduced by the pressing surfaces 33*a*. Thus, even when the signature W comes into contact with the stopper portion 32*a* of the stripper 32, the front end of the signature W is not damaged or deformed, and further the signature W does not bounce off.

Moreover, when the rotational speed N of the printing-press driving motor 51 is further increased, the rotational speed N eventually becomes constant. Then, after the printing is ended, the rotational speed N of the printing-press driving motor 51 is gradually decreased to reach the set rotational speed No. Furthermore, when the rotational speed N of the printing-press driving motor 51 is further decreased below the set rotational speed No, the driving of the speed-reduction-guide moving motor 40 causes the speed-reduction guides 33 to move from the high-speed pressing position H2 to the low-speed pressing position H1. In other words, since the rotational speed N of the printing-press driving motor 51 immediately before the stop of the operation is low, the speed-reduction guides 33 are moved to the low-speed pressing position H1 corresponding to the low-rotational-speed range of the printing-press driving motor 51.

Accordingly, in the control device 57, the rotational-speed ranges below and above the set rotational speed No, which is inputted to be set in advance, are set respectively as the low-rotational-speed range and the high-rotational-speed range, of the printing-press driving motor 51. The control device 57 compares the detected rotational speed N of the printing-press driving motor 51 with the set rotational speed No, so as to determine whether the rotational speed N is in the low-rotational-speed range or in the high-rotational-speed range. When the rotational speed N is included in the low-rotational-speed range, the control device 57 moves the speed-reduction guides 33 to the low-speed pressing position H1. On the other hand, when the rotational speed N is included in the high-rotational-speed range, the control device 57 moves the speed-reduction guides 33 to the high-speed pressing position H2, which is disposed lower than the low-speed pressing position H1. In this way, the pressing force applied by the speed-reduction guides 33 to the signature W can be adjusted on the basis of the rotational speed N of the printing-press driving motor 51, that is, on the basis of the advancing speed of the signature W. Accordingly, the signature W can be securely held in the fan wheels 31.

Next, descriptions will be given of moving operation processing which is performed by the control device 57 on the speed-reduction guides 33 in order to adjust the pressing force thereof.

First of all, in Step S1, it is determined whether or not the rotational speed No which is set in advance in the rotational-speed-setting input unit 56 is changed. If the determination is YES, another rotational speed No is inputted in Step S2. On the other hand, if the determination is NO, the processing proceeds directly to Step S3.

In Step S3, it is determined whether or not web data, such as the paper quality, the paper thickness, and the folding specification, has been inputted to the web-data input unit 55. If the determination is YES, the speed-reduction-guide moving motor 40 is driven in Step S4, so that the speed-reduction guides 33 are moved, on the basis of the web data, to the low-speed pressing position H1 corresponding to the low-rotational-speed range. On the other hand, if the determination is NO, the detection in Step S3 is continued.

In Step S5, it is determined, from the rotational angle of the speed-reduction-guide moving motor 40, whether or not the speed-reduction guides 33 have been moved to the low-speed pressing position H1. Here, the rotational angle is detected by the speed-reduction-guide rotary encoder 41. If the determination is YES, the speed-reduction-guide moving motor 40 is stopped in Step S6. On the other hand, if the determination is NO, the detection in Step S5 is continued.

In Step S7, it is determined whether or not the machine-start button 53 has been turned ON. If the determination is YES, the printing-press driving motor 51 starts to be driven in Step S8, so that the printing operation starts. On the other hand, if the determination is NO, the detection in Step S7 is continued.

In Step S9, it is determined whether or not the current rotational speed N of the printing-press driving motor 51 is equal to or higher than the set rotational speed No. Here, the current rotational speed N is detected by the printing-press rotary encoder 52. If the determination is YES, the speed-reduction-guide moving motor 40 is driven in Step S10, so that the speed-reduction guides 33 are moved, on the basis of the web data, to the high-speed pressing position H2 corresponding to the high-rotational-speed range. On the other hand, if the determination is NO, the detection in Step S9 is continued.

In Step S11, it is determined, from the rotational angle of the speed-reduction-guide moving motor 40, whether or not the speed-reduction guides 33 have been moved to the high-speed pressing position H2. Here, the rotational angle is detected by the speed-reduction-guide rotary encoder 41. If the determination is YES, the speed-reduction-guide moving motor 40 is stopped in Step S12. On the other hand, if the determination is NO, the detection in Step S11 is continued.

In Step S13, it is determined whether or not the machine-stop button 54 has been turned ON. If the determination is YES, the printing-press driving motor 51 is stopped in Step S14. On the other hand, if the determination is NO, the detection in Step S13 is continued.

In Step S15, it is determined whether or not the current rotational speed N of the printing-press driving motor 51 is lower than the set rotational speed No. Here, the current rotational speed N is detected by the printing-press rotary encoder 52. If the determination is YES, the speed-reduction-guide moving motor 40 is driven in Step S16, so that the speed-reduction guides 33 are moved to the low-speed pressing position H1 corresponding to the low-rotational-speed range. On the other hand, if the determination is NO, the detection in Step S15 is continued.

In Step S17, it is determined, from the rotational angle of the speed-reduction-guide moving motor 40, whether or not the speed-reduction guides 33 have been moved to the low-speed pressing position H1. Here, the rotational angle is detected by the speed-reduction-guide rotary encoder 41. If the determination is YES, the speed-reduction-guide moving motor 40 is stopped in Step S18, so that the processing is ended. On the other hand, if the determination is NO, the detection in Step S17 is continued.

In the above-described moving operation processing performed on the speed-reduction guides 33, the speed-reduction guides 33 are moved in Step S9 when the rotational speed N is equal to or higher than the set rotational speed No ($No \leqq N$), while the speed-reduction guides 33 are moved in Step S15 when the rotational speed N is lower than the set rotational speed No ($No > N$). However, it should be noted that, the speed-reduction guides 33 may be moved in Step S9 when the rotational speed N exceeds the set rotational speed N ($No < N$), while the speed-reduction guides 33 may be moved in Step S15 when the rotational speed N is equal to or lower than the set rotational speed No ($No \geqq N$).

In addition, this embodiment is configured as follows. Specifically, the speed-reduction guides 33 are disposed above the signature W advancing between the fan blades 31*a* of the fan wheels 31, so that the upper surface of the signature W is pressed by the speed-reduction guides 33 from the upstream side in the rotational direction of the fan wheels 31. However, it is also possible that, the speed-reduction guides 33 are disposed below the signature W, so that the lower surface of the signature W is pressed by the speed-reduction guides 33 from the downstream side in the rotational direction of the fan wheels 31. Further, it is also possible that the speed-reduction guides 33 are movably supported by the rotational shaft 31*b* in a direction orthogonal to its shaft center, and that the low-speed pressing position H1 is located in the position withdrawn from the high-speed pressing position H2.

Furthermore, in this embodiment, the height position (the low-speed pressing position H1 and the high-speed pressing position H2) of the speed-reduction guides 33 is set on the basis of the web data, such as the paper quality, the paper thickness, and the folding specification. However, the height position of the speed-reduction guides 33 may be set on the basis of web data of at least one of the paper quality, the paper thickness, and the folding specification.

As described above, according to the sheet-speed reduction mechanism for a fan wheel of the present invention, before the signature W advancing between the fan blades 31*a* of the fan wheels 31 comes into contact with the stopper portion 32*a* of the stripper 32, the signature W is pressed, in the rotational direction of the fan wheels 31, by the pressing surfaces 33*a* of the speed-reduction guides 33. The advancing speed of the signature W can be thus reduced. Accordingly, when the signature W comes into contact with the stopper portion 32*a* of the stripper 32, the front end of the signature W is prevented from being damaged or deformed, and concurrently, the bouncing off of the signature W from the stopper portion 32*a* is suppressed. As a result, the signature W can be discharged with a stable attitude from the fan wheels 31. Moreover, since the pressing surface 33*a* of each of the speed-reduction guides 33 is formed to have substantially the same radius of curvature as that of the surface 31*c* of each of the fan blades 31*a* of the fan wheels 31, the surface, to be pressed, of the signature W can be prevented from being damaged by the pressing surfaces 33*a*.

Furthermore, the speed-reduction guides 33 are allowed to move (the height position thereof are allowed to be switched) between the low-speed pressing position H1, which corresponds to the low-rotational-speed range of the printing-press driving motor 51, and the high-speed pressing position H2, which corresponds to the high-rotational-speed range thereof. This makes it possible to adjust the pressing force against the signature W on the basis of the rotational speed N of the printing-press driving motor 51, that is, on the basis of the advancing speed of the signature W.

Specifically, a small pressing force is applied to the upper surface of the signature W advancing at a low speed. Accordingly, even when the speed of the signature W is reduced, the signature W is allowed to come into contact with, and to thus be held by, the stopper portion 32*a* of the stripper 32. On the other hand, a large pressing force is applied to the upper surface of the signature W advancing at a high speed. Accordingly, the speed of the signature W can be sufficiently reduced before the signature W comes into contact with the stopper portion 32*a* of the stripper 32. As a result, even when the signature W comes into contact with the stopper portion 32*a*, it is possible to prevent the damage and deformation of the front end of the signature W, and also the bouncing off of the signature W.

According to the sheet-speed reduction mechanism for a fan wheel according to the present invention, when a sheet comes into contact with a stopper, damage or deformation of a front end of the sheet is prevented, and concurrently, the bouncing off of the sheet is also suppressed. As a result, the sheet can be discharged with a stable attitude to the outside from the inside of the fan wheel. In addition, since the pressing surface of the speed-reduction means is formed to have substantially the same radius of curvature as that of the surface of each of the fan blades of the fan wheel, the sheet being pressed can be prevented from being damaged. Moreover, since the speed-reduction means is configured to be movable between the low-speed pressing position and the high-speed pressing position on the basis of the speed of the printing press, the pressing force against the sheet can be adjusted on the basis of the speed of the printing press, that is, the advancing speed of the sheet.

The present invention may be employed to a guide mechanism for a fan wheel, in which mechanism the attachment position of a guide member for guiding an advancing signature is automatically adjusted when the paper quality, the paper thickness, the folding specification, or the like is changed.

The invention thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A delivery device for a printing press, comprising:

a fan wheel which holds, between fan blades thereof, a sheet transported from a printing press thereto, and which rotates with the held sheet;

a stopper which restricts the front end of the sheet held between the fan blades, and which then discharges the sheet from the inside of the fan wheel;

speed-reduction means which presses a surface of the sheet advancing between the fan blades before the front end of the sheet comes into contact with the stopper, so as to reduce the speed of the sheet, the speed-reduction means being movable relative to the fan wheel;

moving means for moving the speed-reduction means relative to the fan wheel;

a web-data input device to which web data including quality, thickness, and folding specification of the sheet in input; and a control device that adjusts a position of the speed-reduction means by controlling the moving means based on the web data input to the web-data input device.

2. The delivery device for a printing press according to claim 1, wherein the speed-reduction means is provided to the stopper.

3. The delivery device for a printing press according to claim 1, wherein the speed-reduction means includes a pressing surface which is formed to have substantially the same radius of curvature as that of a surface, on the upstream side of the rotational direction of the fan wheel, of each of the fan blades.

4. The delivery device for a printing press according to claim 1, wherein the moving means is a motor.

5. A delivery device for a printing press, comprising:

a fan wheel which holds, between fan blades thereof, a sheet transported from a printing press thereto, and which rotates with the held sheet;

a stopper which restricts the front end of the sheet held between the fan blades, and which then discharges the sheet from the inside of the fan wheel; and speed-reduction means which presses a surface of the sheet advancing between the fan blades before the front end of the sheet comes into contact with the stopper, so as to reduce the speed of the sheet, wherein the speed-reduction means moves on the basis of any one of the quality, the thickness, and the folding specification, of the sheet, and wherein the speed-reduction means moves in up and down directions.

6. A delivery device for a printing press, comprising:

a fan wheel which holds, between fan blades thereof, a sheet transported from a printing press thereto, and which rotates with the held sheet;

a stopper which restricts the front end of the sheet held between the fan blades, and which then discharges the sheet from the inside of the fan wheel; and speed-reduction means which presses a surface of the sheet advancing between the fan blades before the front end of the sheet comes into contact with the stopper, so as to reduce the speed of the sheet, wherein the speed-reduction means moves on the basis of any one of the quality, the thickness, and the folding specification, of the sheet, and wherein the speed-reduction means is configured:

to move so as to increase the pressing force thereof against the surface of the sheet when the speed of the printing press is equal to or higher than a predetermined speed; and to move so as to decrease the pressing force thereof against the surface of the sheet when the speed of the printing press is lower than the predetermined speed.

7. A delivery device for a printing press, comprising:

a fan wheel which holds, between fan blades thereof, a sheet transported from a printing press thereto, and which rotates with the held sheet;

a stopper which restricts the front end of the sheet held between the fan blades, and which then discharges the sheet from the inside of the fan wheel; and speed-reduction means which presses a surface of the sheet advancing between the fan blades before the front end of the sheet comes into contact with the stopper, so as to reduce the speed of the sheet, wherein the speed-reduction means moves on the basis of any one of the quality, the thickness, and the folding specification, of the sheet, and wherein the speed-reduction means is configured:

to move so as to increase the pressing force thereof against the surface of the sheet when the speed of the printing press is higher than a predetermined speed; and to move so as to decrease the pressing force thereof against the surface of the sheet when the speed of the printing press is equal to or lower than the predetermined speed.

8. A delivery device for a printing press, comprising:

a fan wheel which holds, between fan blades thereof, a sheet transported from a printing press thereto, and which rotates with the held sheet;

a stopper which restricts the front end of the sheet held between the fan blades, and which then discharges the sheet from the inside of the fan wheel; and speed-reduction means which presses a surface of the sheet advancing between the fan blades before the front end of the sheet comes into contact with the stopper, so as to reduce the speed of the sheet, wherein the speed-reduction means moves on the basis of any one of the quality, the thickness, and the folding specification, of the sheet, and wherein the speed-reduction means is configured:

to move to a high-speed pressing position so as to apply a first pressing force to the surface of the sheet when the speed of the printing press is equal to or higher than a predetermined speed; and to move to a low-speed pressing position so as to apply a second pressing force to the surface of the sheet when the speed of the printing press is lower than a predetermined speed, the second pressing force being smaller than the first pressing force.

9. A delivery device for a printing press, comprising:

a fan wheel which holds, between fan blades thereof, a sheet transported from a printing press thereto, and which rotates with the held sheet;

a stopper which restricts the front end of the sheet held between the fan blades, and which then discharges the sheet from the inside of the fan wheel; and speed-reduction means which presses a surface of the sheet advancing between the fan blades before the front end of the sheet comes into contact with the stopper, so as to reduce the speed of the sheet, wherein the speed-reduction means moves on the basis of any one of the quality, the thickness, and the folding specification, of the sheet, and wherein the speed-reduction means is configured:

to move to a high-speed pressing position so as to apply a first pressing force to the surface of the sheet when the speed of the printing press is higher than a predetermined speed; and to move to a low-speed pressing position so as to apply a second pressing force to the surface of the sheet when the speed of the printing press is equal to or lower than the predetermined speed, the second pressing force being smaller than the first pressing force.

10. The delivery device for a printing press according to any one of claims 8 and 9, wherein the low-speed pressing position is located above the high-speed pressing position.

11. A delivery device for a printing press, comprising:

a fan wheel which holds, between fan blades thereof, a sheet transported from a printing press thereto, and which rotates with the held sheet;

a stopper which restricts the front end of the sheet held between the fan blades, and which then discharges the sheet from the inside of the fan wheel;

speed-reduction means which presses a surface of the sheet advancing between the fan blades before the front end of the sheet comes into contact with the stopper, so as to reduce the speed of the a movable member which supports the speed-reduction means;

moving means which moves the movable member a supporting member which movably supports the movable member with a guide member disposed in between; and a spring which is set between the guide member and the supporting member, wherein the speed-reduction means moves on the basis of any one of the quality, the thickness, and the folding specification, of the sheet.

12. The delivery device for a printing press according to claim 11, wherein the moving means comprises:

a screw shaft which is screwed into the movable member, and also which is rotatably supported by the supporting member; and a motor which rotates the screw shaft.

* * * * *